United States Patent [19]

Challet

[11] 4,422,124

[45] Dec. 20, 1983

[54] PUSH-BUTTON AND PERCUSSION TYPE PIEZOELECTRIC IGNITER

[75] Inventor: Jacques S. Challet, Ceaux d'Allegre, France

[73] Assignee: R. V. Constructions Electriques, France

[21] Appl. No.: 341,616

[22] Filed: Jan. 22, 1982

[30] Foreign Application Priority Data

Jan. 23, 1981 [FR] France ..... 81 01420

[51] Int. Cl.[3] ..... H04R 17/00

[52] U.S. Cl. ..... 361/260; 310/339

[58] Field of Search ..... 361/260; 310/339

[56] References Cited

U.S. PATENT DOCUMENTS 3,751,690 8/1973 Okamoto ..... 310/8.7
3,800,171 3/1974 Ishii et al. ..... 310/339
3,829,737 8/1974 Johnsson ..... 361/260
3,866,069 2/1975 Ishii et al. ..... 361/260

*Primary Examiner*—C. C. Shaw
*Attorney, Agent, or Firm*—Parkhurst & Oliff

[57] ABSTRACT

A push-button and percussion type piezoelectric igniter, having a percussion mass comprising two diametrically opposite stubs displaceable on an incline provided for that purpose on the body of the push-button, a spring resting inside the body of the push-button and on the percussion mass respectively, for propelling the mass, a casing for receiving at one end the assembly comprising the push-button, spring and percussion mass, and at its other end the impact assembly comprising a striker, piezoelectric crystal, anvil, connection and locking part, wherein this casing comprises on its inside surface two diametrically opposite longitudinal grooves, and two apertures which are also diametrically opposite and slightly offset from said grooves receiving stubs of the percussion mass.

4 Claims, 4 Drawing Figures

PUSH-BUTTON AND PERCUSSION TYPE PIEZOELECTRIC IGNITER

BACKGROUND

The invention concerns a spark-generating piezoelectric igniter of the percussion and push-button trigger type.

Igniter devices or piezoelectric igniter devices are well known and are used in particular to generate sparks to inflame certain gaseous mixtures. Because such devices are widely known they need not be described in detail.

A device of this type is described in the French Pat. No. 1 554 247, wherein the percussion member consists of a metal rod and a piezoelectric element rigidly connected to it, said element when acted upon by an energy storing means in the actuation of the device impacts a fixed anvil causing a spark to fly. However such a device is rather complex, comprises many parts and most of all requires, on account of the necessary displacement of the piezoelectric element, that the high voltage terminal make contact with the anvil and that it not be permanently connected to the piezoelectric element itself. As a result, the amount of generated electrical energy can only be delivered in an uncertain manner to the spark gap, there being no assurance of proper contact between the percussion element and the anvil following the impact (also see U.S. Pat. No. 3,751,690 and German Offenlegungsschrift No. 2 853 326).

As a rule the push-button and percussion type piezoelectric igniters marketed to date consist essentially of:

a percussion mass capable of elastic displacement and provided with two diametrically opposite stubs displaceable on an incline made for that purpose on the push-button body;

a spring resting against the stubs and the inside of the push-button body respectively;

a plastic, insulating cylindrical casing, conventional for this application, which is both shock and temperature resistant, and of which one end receives the push-button assembly and the percussion mass, and the other end of which receives the conventional impact assembly comprising essentially the striker, the piezoelectric crystal, the anvil, the connection and the lock washer.

Briefly, when the push-button is depressed, the spring is compressed, whereupon the stubs move on the inclines until at the end of their travel the percussion mass is abruptly released so that, under the influence of said spring, it impacts the impact assembly and thus generates the spark. Thereupon the mass is returned to its initial position by a suitable return spring.

Even though these devices are in fairly widespread use, they still suffer from the substantial drawback that they are tedious to manufacture and assemble and their fabrication is not easily automated.

BRIEF SUMMARY OF THE INVENTION

The present invention overcomes these drawbacks. It concerns an igniter of the type discussed above which can be easily manufactured and which is both reliable and economical.

This push-button and percussion type piezoelectric igniter comprises:

a percussion mass with two diametrically opposite stubs displaceable on an incline made for that purpose on the body of the push-button;

a spring resting inside the push-button body and on the percussion mass, respectively, for impelling this mass;

a casing for receiving at one of its ends the push-button, spring and percussion mass assembly, and at its other end the impact assembly of striker, piezoelectric crystal, anvil, connection and locking means, and is characterized in that the casing comprises:

two inside, diametrically opposite longitudinal grooves; and two apertures which also are diametrically opposite and slightly offset from said grooves to receive the percussion mass stubs.

Advantageously, the push-button comprises two diametrically opposite longitudinal slots joining two openings wherein are fashioned the two opposite parallel inclines on which rest the percussion mass stubs. The push-button is provided with two diametrically opposite stubs whose widths correspond substantially to that of the grooves fashioned in the casing, these stubs being arranged at the tip of each of the two inclines, perpendicularly to and slightly offset from the percussion mass stubs. The two parallel inclines subtend angles of about 30°. The two apertures fashioned in the casing are tangential to the longitudinal grooves fashioned within this casing, and those longitudinal grooves include a step in the form of a constriction located just opposite these apertures. The offset between the longitudinal axis of these grooves fashioned within the casing and the apertures substantially corresponds to the offset between the push-button stubs and the percussion mass stubs when the percussion mass stubs are located at the bottom of the incline. The distance between the casing entry and the apertures fashioned in the casing is almost the same as the distance between these stub pairs respectively located on the push-button and on the percussion mass, when the percussion mass stubs are in the upward position.

BRIEF DESCRIPTION OF THE DRAWINGS

The manner of implementing the invention and the ensuing advantages will be better understood in relation to the following illustrative example and the attached figures, without thereby implying any limitation.

DETAILED DESCRIPTION

Figure 1:
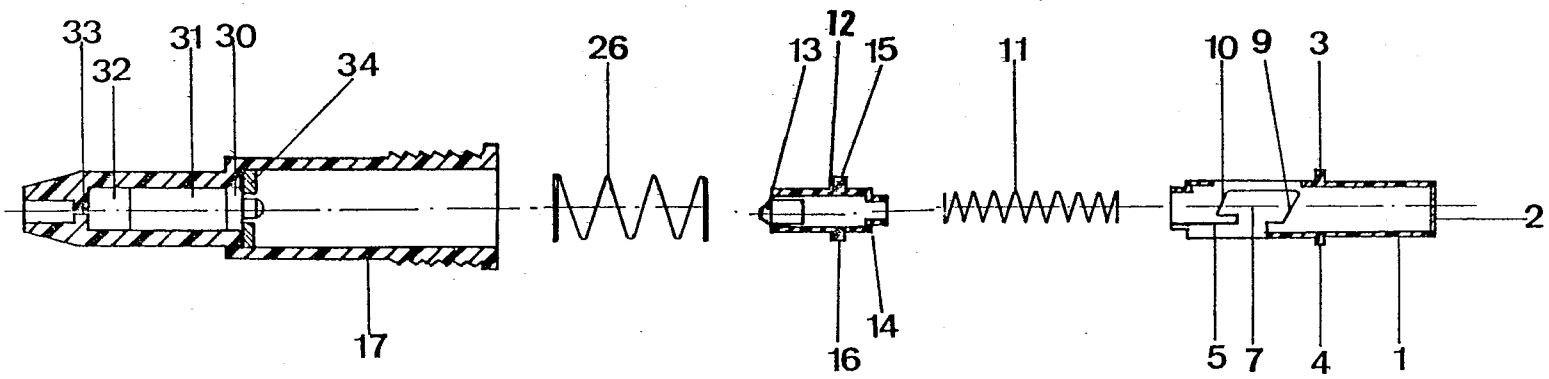
FIG. 1 schematically illustrates a longitudinal section of a piezoelectric igniter according to the invention.

The piezoelectric igniter of the invention (FIG. 1) comprises a push-button 1 made of a suitable molded plastic in the shape of a hollow cylinder closed at its outer end 2 and comprising on its surface two diametrically opposite stubs 3 and 4 arranged substantially in the transverse direction, and two longitudinal slots 5 and 6 joining two openings 7 wherein are fashioned two opposite parallel inclines 9 and 10, sloping, for example at an angle of 30°. The tip of the incline 9 is located substantially opposite the corresponding stub 3. A spring 11 is located within this push-button 1, against the end of which rests the percussion mass 12. Percussion mass 12 consists of a percussion mass proper 13 made of an appropriate steel and sunk into a plastic cylindrical body 14 with two diametrically opposite stubs 15 and 16 arranged in the longitudinal direction, that is perpendicularly to the axis of the stubs 3 and 4 on the button 1.

Figure 2:
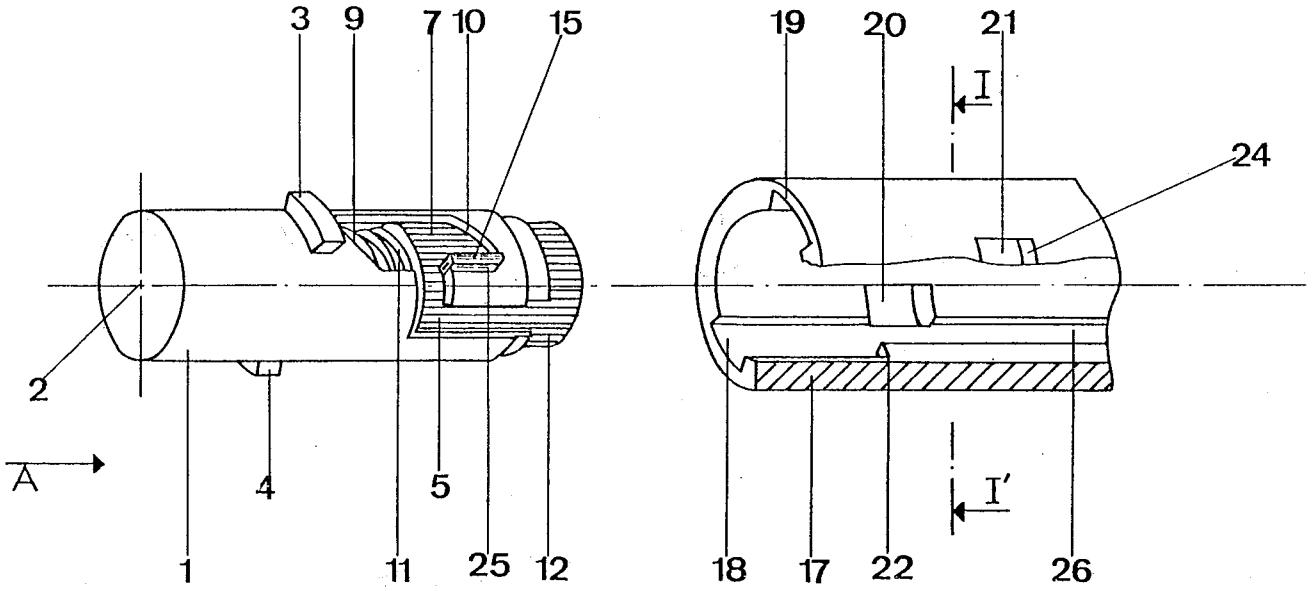
FIG. 2 is a schematic perspective showing the main components of this igniter.
Figure 3:
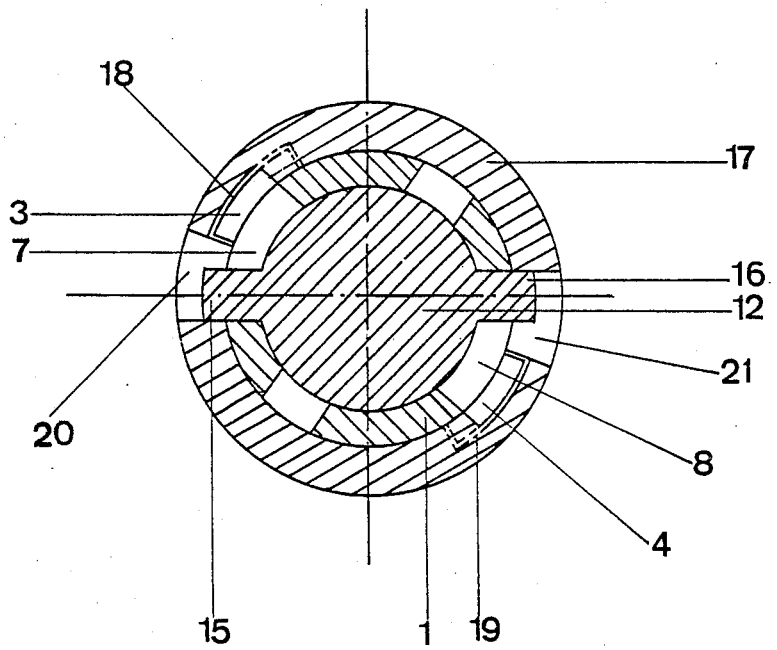
FIG. 3 is a section along the axis I—I′ of FIG. 2.
Figure 4:
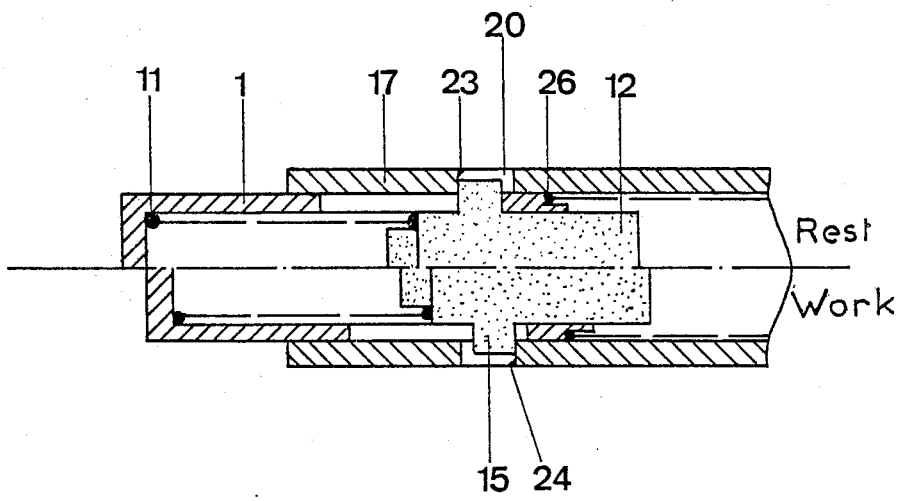
FIG. 4 is a summary section of the different components in their rest and operational positions, respectively.

Casing 17 is in the shape of a hollow cylindrical body and made of a molded plastic. At its end is located the conventional impact assembly summarily shown herein comprising the striker 30, piezoelectric crystal 31, anvil 32, connection 33, and lock washer 34. Casing 17 comprises:

(a) two diametrically opposite longitudinal grooves 18–19 in its inner surface, whose widths correspond at least to the widths of the stubs 3–4 so that the latter can enter these grooves 18–19, and (b) two apertures 20–21, which are also mutually diametrically opposite and a slightly offset from the longitudinal grooves 18–19. The offset between the longitudinal axis of these grooves 20 and 21 and the longitudinal axis of the grooves 18–19 corresponds to the offset between the stubs 3–4 of the push-button 1 and the stubs 15–16 of the percussion mass 12 when it is in the assembled position, that is when the stubs 15–16 are placed at the bottom of the groove 10. Similarly, the distance between the entry of the casing 17 and these apertures 20–21 substantially corresponds to the distance between the pairs of stubs 3–4 and 15–16 when they too are in the assembled position. As shown in FIG. 2, these apertures 20–21 are tangential to the grooves 18–19 and the top of these apertures 20–21 is just opposite a step 22 located in grooves 18–19 and forms a constriction of those grooves that thereupon continue more narrowly.

To assesmble the push-button sub-assembly, the spring 11 is placed in the cylindrical internal housing of button 1. By compressing spring 11, the stubs 15–16 of the percussion mass 12 are inserted into the aperture 5–6, and thereupon, by slightly pivoting the entire assembly to the right, the stubs 15–16 are engaged in the openings 7 so that those stubs will come to rest against the bottom of the incline 10. By means of this bayonet system, therefore, the percussion mass is reliably locked into this sub-assembly.

To close and lock the igniter, the stubs 15–16 are then engaged into the grooves 18–19 of the casing 17. In doing so, a lighter spring 26 in the casing 17 is compressed, this spring being calibrated to bring the push-button back into its initial position. This spring 26 rests on one hand on the washer 34 and on the other on the collar of the button 1. When the stubs 3 and 4 of the button 1 hit the forward side of the body 17, a slight rotational motion to the right is imparted next to the button 1, whereby the stubs 15–16 are directed toward apertures 20–21 and simultaneously the stubs 3–4 of the button 1 engage the grooves 18–19.

Following a slight displacement of the button 1, the stubs 15–16 of the mass 12 will be seated in the apertures 20–21 of the casing 17, more specifically, on the rear sides 23 of these apertures, and simultaneously at the bottom of the incline 10 of the button 1. In this manner the sub-assembly of button 1, spring 11 and percussion mass 12 is locked in the casing 17 and it is no longer readily possible to remove it except by pushing on these stubs 15 and 16 to bring them back to the step 22 by impressing on them a rotational motion.

To generate a spark, the button 1 is depressed in the direction of the arrow A in FIG. 2. At that time the stubs 15–16 of the percussion mass 12 will move slightly forward and come to rest on the fore sides 24 of the apertures 20–21. With continued depression of the button 1, the stubs 15–16 locked on the fore side 24 will move along the wall 25 of their respective openings 7 until they come to rest on opposite parallel incline 9. When the stub 15 makes contact with this incline 9, the slope of this incline assures that stub 15, which still rests against the side 24 of the casing 17, pivots from right to left until opposite the extension 26 of groove 18. In this manner the percussion mass 12 will be abruptly thrust forth by spring 11 and thus suddenly released, whereby it will strike the conventional impacted assembly 30–33, and the spark will be generated.

The invention offers many advantages over the devices that have been marketed to date. Among these are:

ease of construction and assembly, possible automation reliability low manufacturing costs locking the percussion assembly without additional pieces.

Thus this igniter can be successfully used for ignition of gas appliances, whether of the household or other type, to which it can be fitted for example using a thread 34 at the end of the casing 17 or any other means such as clip means.

What is claimed is:

1. A push-button and percussion type piezoelectric igniter, consisting of:

a cylindrical pushbutton body (1) comprising:

(a) two diametrically opposite longitudinal parallel slots (5–6) joining two openings (7) wherein are provided two opposite parallel inclines (9–10), (b) two diametrically opposite stubs (3–4) located at the tip of each of the two inclines (9–10);

a percussion mass (12) comprising two diametrically opposite stubs (15–16) displaceable on one of the inclines (10) on the body of the push-button (1), which inclines are arranged perpendicularly to, but slightly offset from, the stubs (3–4) of the push-button (1);

a spring (11) resting inside the body of the push-button (1) and on the percussion mass (12) respectively, for propelling said mass (12);

a casing (17) for receiving at one end the assembly comprising push-button (1), spring (11) and percussion mass (12), and at its other end the impact assembly comprising a striker (30), piezoelectric crystal (31), anvil (32), connection (33) and locking part (34), said casing (17) comprising:

(a) on its inside surface two diametrically opposite longitudinal grooves (18–19–26) whose widths correspond to the widths of the stubs (3–4) of the push-button (1), and (b) two diametrically opposite apertures (20–21) slightly offset from said grooves receiving the stubs (15–16) of the percussion mass (12), said apertures (20–21) being tangential to the longitudinal grooves (18–19) inside the casing (17).

2. A percussion and push-button type piezoelectric igniter, comprising:

a push-button body (1);

a percussion mass (12) provided with two diametrically opposite stubs (15–16) displaceable on an incline (10) on push-button body (1);

a spring (11) resting on the inside of the body of push-button (1) and on the percussion mass (12), respectively, for propelling said mass (12);

a casing (17) for receiving at one end the assembly including push-button (1), spring (22) and percussion mass (12), and at its other end an impact assembly comprising striker (30), piezoelectric crystal (31), anvil (32), connection (33) and locking part (34), wherein casing (17) comprises:

(a) on its inside two diametrically opposite longitudinal grooves (18–19–26); and, (b) two diametrically opposite apertures (20–21) which are slightly offset from said grooves, said apertures receiving stubs (15–16) of the percussion mass (12); and wherein the push-button (1) comprises two diametrically opposite stubs (3–4) whose width corresponds to that of the grooves (18–19) of the casing (17) and which are arranged at the tip of each of the inclines (9) to be perpendicular to and slightly offset from the stubs (15–16).

3. The igniter of claim 2, wherein the offset between the longitudinal axis of the grooves (18–19) and the apertures (20–21) corresponds to the offset between the stubs (3–4) of the push-button (1) and the stubs (15–16) of the percussion mass (12) when said stubs (15–16) are located at the bottom of the incline (10).

4. The igniter of claim 3, wherein the distance between the entry of the casing (17) and the apertures (20–21) is approximately the distance between the pairs of stubs (3–4) and (15–16) when these latter stubs (15–16) are located at the bottom of the incline (10).

* * * * *